US009236212B2

(12) United States Patent
Tanaka et al.

(10) Patent No.: US 9,236,212 B2
(45) Date of Patent: Jan. 12, 2016

(54) TUNGSTEN WIRE, CATHODE HEATER AND VIBRATION SERVICE LAMP FILAMENT

(75) Inventors: Takashi Tanaka, Tokyo (JP); Motohisa Sakai, Yokohama (JP); Yasuhiko Nakano, Yokohama (JP); Kan Suganomata, Fujisawa (JP); Motoaki Esaki, Yokosuka (JP); Kayo Nakano, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 20 days.

(21) Appl. No.: 13/471,733

(22) Filed: May 15, 2012

(65) Prior Publication Data

US 2012/0285586 A1 Nov. 15, 2012

Related U.S. Application Data

(60) Continuation of application No. 12/632,348, filed on Dec. 7, 2009, now abandoned, which is a division of application No. 10/491,793, filed as application No. PCT/JP02/10474 on Oct. 9, 2002, now abandoned.

(30) Foreign Application Priority Data

Oct. 9, 2001 (JP) ..... 2001-311533

(51) Int. Cl.
*C22F 1/18* (2006.01)
*H01J 1/146* (2006.01)
(Continued)

(52) U.S. Cl.
CPC ..... *H01J 1/146* (2013.01); *B21C 1/003* (2013.01); *B21C 37/045* (2013.01); *B22F 5/12* (2013.01);
(Continued)

(58) Field of Classification Search
CPC ..... B22F 5/12
USPC ..... 148/514
See application file for complete search history.

(56) References Cited

U.S. PATENT DOCUMENTS 5,087,299 A 2/1992 Fukuchi et al.
6,066,019 A 5/2000 Bewlay
6,419,758 B1 7/2002 Bewlay et al.

FOREIGN PATENT DOCUMENTS

GB 1053020 5/1965
JP 57-39152 A 3/1982
(Continued)

OTHER PUBLICATIONS

Machine translation of JP '731.*
(Continued)

*Primary Examiner* — Jessee Roe
*Assistant Examiner* — Christopher Kessler
(74) *Attorney, Agent, or Firm* — Foley & Lardner LLP

(57) ABSTRACT

One embodiment provides a tungsten wire containing 1 to 10% by mass of rhenium, the wire having a point indicating a 2% elongation within a quadrangle formed by joining points with straight lines, where the values of x and y are point (20, 75), point (20, 87), point (90, 75), and point (90, 58), in this order; wherein the wire diameter of the tungsten wire is represented by x μm, and the elongation of the tungsten wire is 2% after electrically heating with an electrical current which is a ratio of y % to the fusion current (FC) at the wire diameter x μm, and wherein a semi-logarithmic system of coordinates is expressed by a horizontal axis using a logarithmic scale of the wire diameter x and a vertical axis using a normal scale of ratio y to the fusion current.

16 Claims, 9 Drawing Sheets

(51) Int. Cl.

| | |
|---|---|
| ***B21C 1/00*** | (2006.01) |
| ***B21C 37/04*** | (2006.01) |
| ***B22F 5/12*** | (2006.01) |
| ***C22C 1/04*** | (2006.01) |
| ***C22C 27/04*** | (2006.01) |
| ***H01J 1/14*** | (2006.01) |
| ***H01J 1/22*** | (2006.01) |
| ***H01J 9/04*** | (2006.01) |
| ***H01J 9/08*** | (2006.01) |
| ***H01K 1/02*** | (2006.01) |
| ***H01K 3/02*** | (2006.01) |
| *B21B 1/18* | (2006.01) |
| *B21B 15/00* | (2006.01) |
| *B21B 3/00* | (2006.01) |

(52) U.S. Cl.

CPC ..... *C22C 1/045* (2013.01); *C22C 27/04* (2013.01); *H01J 1/14* (2013.01); *H01J 1/22* (2013.01); *H01J 9/04* (2013.01); *H01J 9/08* (2013.01); *H01K 1/02* (2013.01); *H01K 3/02* (2013.01); *B21B 1/18* (2013.01); *B21B 15/0035* (2013.01); *B21B 2003/006* (2013.01); *B21B 2015/0028* (2013.01); *B22F 2998/10* (2013.01); *H01J 2201/2889* (2013.01)

(56) References Cited

FOREIGN PATENT DOCUMENTS

| | | | |
|---|---|---|---|
| JP | 03-219039 | A | 9/1991 |
| JP | 2001-152275 | A | 6/2001 |
| JP | 2001-226735 | A | 8/2001 |
| JP | 2002-075059 | A | 3/2002 |
| JP | 2002-173731 | A | 6/2002 |

OTHER PUBLICATIONS

Machine translation of JP ’059.*

* cited by examiner

Prior Art

TUNGSTEN WIRE, CATHODE HEATER AND VIBRATION SERVICE LAMP FILAMENT

CROSS-REFERENCE TO RELATED APPLICATIONS

The present application is a Continuation of U.S. application Ser. No. 12/632,348, filed Dec. 7, 2009, now abandoned, which is a Divisional of U.S. application Ser. No. 10/491,793, filed Apr. 6, 2004, now abandoned, which is based upon PCT National Stage Application No. PCT/JP2002/10474 filed Oct. 9, 2002, and claims the benefit of priority from prior Japanese Patent Application No. 2001-311533, filed Oct. 9, 2001, and the entire contents of each of these applications are incorporated herein by reference.

TECHNICAL FIELD

The present invention relates to tungsten wire, and in particular relates to a tungsten wire and a cathode heater with extensive elongation under conditions of high temperature, capable of exhibiting excellent shock resistance and durability (longevity) when used as a component of a vibration service lamp filament or a cathode heater.

BACKGROUND ART

In general, various tungsten wires have been widely used as components for discharge electrodes, contact elements, high temperature structural elements, filament material for use in lighting for home electrical appliances or automobile lamps, and cathode heaters for electron guns used in televisions. In particular, tungsten wire, which includes a fixed amount of rhenium (Re), is widely used as a filament material for vibration service lamps and electronic tube heaters, because of its high temperature strength and ductility (shock resistance) after recrystallization.

FIG. 9 is a partial perspective diagram illustrating a component example of a cathode heater 20 which is used in image receiving tubes, and has a construction wherein a tungsten wire (W wire) 21 having a wire diameter of approximately 30 to 50 μm is wound in a spiral as a heating element, with the perimeter thereof coated with an insulation of ceramics film 22. Applying electricity to this cathode heater heats the cathode of the image receiving tube to a high temperature, whereby electrons in the atoms making up the cathode are freed, thereby yielding thermionic discharge.

Tungsten wires for the construction of the above-described cathode heaters and the like, in general have been manufactured using a manufacturing process similar to the description in FIG. 2. That is, a bar of green compact is formed by pressure molding tungsten powder which includes a fixed amount of Re or dopant such as Al, Si, and K, and tungsten sintered compact 1 is prepared by using each end of this green compact as a terminal, passing electricity through and sintering.

Next, after repeating several times the operation of heating the obtained tungsten sintered compact 1 with a heating system 2 for use in swaging and the operation of swaging until the heated sintered compact has a fixed processing rate (working ratio) by using a rotary swaging apparatus (hammering apparatus) 3, the work hardened sintered compact is heated in a heat treating furnace 4 and undergoes a recrystallization process, whereby tungsten wire raw material 1*a* is obtained. Further, by repeating several times the swaging operation by means of the swaging apparatus 3 and the heating operation by means of the heating system 2 for use in swaging, the processing rate is further increased, and tungsten wire raw material 1*b* with an even smaller cross-sectional area is formed.

Next, by repeating several times the operation of heating the obtained tungsten wire raw material 1*b* by means of a wire drawing heating system 5 and the operation of wire drawing the heated tungsten wire raw material 1*b* to have a fixed wire diameter by means of a wire drawing apparatus 6, a tungsten wire 7 having a predetermined wire diameter was finally manufactured. The manufactured tungsten wire 7 is wound in a form of coil by means of a winding apparatus 8.

However, regarding the tungsten wires manufactured using the above-described conventional manufacturing process, containing for example approximately 3% by mass of rhenium (Re), in a case wherein the wire diameter was 40 μm, after the heating process was completed at a temperature range of approximately 2000 to 2500° C. (equivalent to electricity application heating of 48 to 65% of electricity applied of the fusion current (FC)), the measured value showed the elongation to be 1% or greater. In contrast, however, in a case wherein the heating process was completed at a much higher temperature (for example, a heating process conducted at a temperature above 67% of the FC or higher), the measured value showed the elongation to be 1% or lower. On the other hand, when the wire diameter is large, such as 0.39 mm, the elongation after completing heat treatment for 2 minutes at a temperature range of 1090° C. to 2390° C. was 5% or greater. In other words, tungsten wires with a large diameter yielded sufficient elongation, even when the wires were subjected to high temperatures.

Further, there were no problems and difficulties with parts used at near room temperatures of under 100° C., such as probe pins formed with a conventional W wire having a large diameter.

However, when used under conditions of high temperatures above 1000° C. such as with cathode heaters, or when applied to uses which include a heat treatment process of over 2500° C. during the manufacturing process, there was the problem of easily decreased durability and longevity of the products in use because the strength and elongation would decrease. For example, generally a tungsten wire with a wire diameter 40 μm made of a rhenium-tungsten (Re—W) alloy which includes a predetermined amount of rhenium is used as a component for constituting a cathode heater used in a Braun tube. Further, other Examples of uses where the W wire temperature during use (or during the manufacturing process) reaches 1000° C. or higher, or even exceeds 2500° C., include vibration service lamp filaments used in fields which accompany locomotive movement or vibration, such as do automobiles or pachinko machines. A manufacturing process wherein the W wire temperature exceeds 2500° C. may include flushing operation after coiling and so forth.

As described above, the heat treatment temperature applied to the W raw materials during manufacture of the above cathode heater and so forth is generally a high temperature of 1500° C. or higher, and depending on the situation can exceed 2500° C., and it is desirable for the materials heat-treated at this temperature to possess a large ductility (elongation, stretching), in order to maintain durability and longevity even within this temperature environment. However, thin wires made from Re—W alloy manufactured using conventional manufacturing processes had the difficulties of losing its elongation when heat treated at 2500° C. or higher, or the elongation gradually decreasing as a cathode heater was used for long periods of time, and problems occurred where the heater elements were damaged by minor impact or vibration in the cathode heater and longevity was decreased. Therefore, there is great demand for the development of tungsten wire that possesses excellent durability even when used in conditions of high temperature in this technical field.

Further, regarding the conventional manufacturing methods of tungsten wire, the tungsten wire raw material is prepared by repeating the heat treatment and swaging processing treatment for a predetermined size and length of tungsten sintered compact (sintered body). However, after performing one heat treatment, the processing rate (working ratio) for processing with the swaging apparatus is at most a low value of 10 to 30%. Therefore, in order to process the fixed tungsten thin wire raw material from a tungsten sintered compact, it is necessary to perform numerous repetitions of heat treatment and swaging processing as illustrated in FIG. 2, and while the manufacturing cost of tungsten wire increases due to the increasingly complicated manufacturing process of repetition of heating and swaging, strain (distortion) accumulates and the hardening effects do not work, so that only tungsten wire having a low tensile strength could be obtained.

The present invention has been made to solve the above problems, and it is an object thereof to provide a highly reliable cathode heater and vibration service lamp filament, and to provide tungsten wire which can be manufactured efficiently, and which can exhibit excellent durability when used as a component for cathode heaters, vibration service lamps, and so forth, which are used under conditions of high temperatures or exposed to high temperatures during the manufacturing process.

DISCLOSURE OF INVENTION

The inventors of the present invention have discovered that tungsten wire having high elongation properties even in an environment using high temperatures can be efficiently manufactured by means of adding the process of rolling at a high process rate of 40 to 75% after providing one heating treatment to swaging process of a tungsten sintered compact, and by precisely controlling the heating temperature when performing electrical heating treatment of a predetermined wire diameter, i.e. the ratio of the heating current value to the fusion current (FC), and thus have completed the present invention.

That is to say, the tungsten wire according to the present invention is a tungsten wire containing 1 to 10% by mass of rhenium, and having a point which indicates a 2% elongation within a quadrangle formed by joining points with straight lines, where the values of x and y are point (20, 75), point (20, 87), point (90, 75), and point (90, 58), in this order, wherein the wire diameter of the tungsten wire is represented by x μm, and the elongation of the tungsten wire is 2% after electrically heating with an electrical current which is a ratio of y % to the fusion current (FC) at the wire diameter x μm, and wherein a semi-logarithmic system of coordinates is expressed by means of a horizontal axis using a logarithmic scale of the wire diameter x and a vertical axis using a normal scale of ratio y to the fusion current.

Further, another tungsten wire according to the present invention is a tungsten wire containing 1 to 10% by mass of rhenium, and having a point which indicates a 5% elongation within a quadrangle formed by joining points with straight lines, where the values of x and y are point (20, 73), point (20, 83), point (90, 72), and point (90, 56), in this order, wherein the wire diameter of the tungsten wire is represented by x μm, and the elongation of the tungsten wire is 5% after electrically heating with an electrical current which is a ratio of y % to the fusion current (FC) at the wire diameter x μm, and wherein a semi-logarithmic system of coordinates is expressed by means of a horizontal axis using a logarithmic scale of the wire diameter x and a vertical axis using a normal scale of ratio y to the fusion current.

Further, another tungsten wire according to the present invention is a tungsten wire containing more than 10% by mass but 30% by mass or less of rhenium, and having a point which indicates a 2% elongation within a quadrangle formed by joining points with straight lines, where the values of x and y are point (20, 55), point (20, 63), point (90, 51), and point (90, 39), in this order, wherein the wire diameter of the tungsten wire is represented by x μm, and the elongation of the tungsten wire is 2% after electrically heating with an electrical current which is a ratio of y % to the fusion current (FC) at the wire diameter x μm, and wherein a semi-logarithmic system of coordinates is expressed by means of a horizontal axis using a logarithmic scale of the wire diameter x and a vertical axis using a normal scale of ratio y to the fusion current.

Further, another tungsten wire according to the present invention is a tungsten wire containing more than 10% by mass but 30% by mass or less of rhenium, and having a point which indicates a 5% elongation within a quadrangle formed by joining points with straight lines, where the values of x and y are point (20, 53), point (20, 60), point (90, 48), and point (90, 37), in this order, wherein the wire diameter of the tungsten wire is represented by x μm, and the elongation of the tungsten wire is 5% after electrically heating with an electrical current which is a ratio of y % to the fusion current (FC) at the wire diameter x μm, and wherein a semi-logarithmic system of coordinates is expressed by means of a horizontal axis using a logarithmic scale of the wire diameter x and a vertical axis using a normal scale of ratio y to the fusion current.

Further, in the above tungsten wire, it is preferable that the tungsten wire contains 40 to 100 ppm of potassium (K).

Further, the cathode heater according to the present invention is configured of the above tungsten wire.

The manufacturing method of the tungsten wire relating to the present invention comprises: a process of heating and rolling a tungsten sintered compact containing 1 to 30% by mass of rhenium; a process of heating and swaging the rolled sintered compact after a recrystallization heating treatment; and a process of heating and wire drawing the swaged sintered compact; wherein the rolling process, establishing the process rate (working ratio) of performing a rolling operation for one heating as 40 to 75%. Herein, the process rate (working ratio) is defined as the value of the difference between before processing and after processing of a cross-sectional area of materials processed, divided by a cross-sectional area before processing.

Further, regarding the above manufacturing methods of the tungsten wire, heating treatment at a temperature of 2300° C. or less is preferably performed at the point that the wire diameter of the tungsten wire, formed by the swaging process or wire drawing process, becomes 100 μm or less.

The tungsten wire relating to the present invention is formed from a material using tungsten (W) as a base, and comprising 70 to 99% by mass of tungsten materials, and preferably 90 to 99% by mass. A specific component example can be given in a Re—W alloy, where the tungsten comprises 1 to 30% by mass of Re. Also, 0.001 to 1% by mass of a dopant element of Al, Si, K, and so forth may be included as necessary. Further, alloys including an alloy containing a third component, such as Re—Mo—W alloy which includes 1 to 10% by mass of Re and 1 to 10% by mass of Mo, or the like may be also used. Among these materials, especially for the materials for tungsten wires to construct cathode heaters and so forth, a Re—W alloy including 40 to 100 ppm of K with solid dispersion of a predetermined amount of Re is preferable from the viewpoints of high strength properties (tensile strength) and hardness (anti-friction, wear-resistance) and improving processing ability (workability) by heightening ductility.

When the tungsten wire contains less than 1% by mass of rhenium, the resistance value of the wire decreases, and the heat-generating properties required as a heater when used as a cathode heater cannot be obtained. On the other hand, in the event that the amount contained in the wire is more than 30% by mass, not only the effect of adding additional Re cannot be obtained but also this further becomes a reason for increased costs because Re is expensive as compared with W. Therefore, the amount of Re contained is set in the range of 1 to 30% by mass, but especially for a W wire for the purpose of a cathode heater, the range of 2 to 5% by mass is more preferable. Also, the same case holds for vibration service lamp filaments.

Further, in a situation where the amount of potassium contained in a tungsten wire is less than 40 ppm, forming the crystal grains of the tungsten so that they elongate long and thin in the direction of the axis becomes difficult, the strength properties of the tungsten wire is decreased and deformation becomes greater, and when used for example as a cathode heater the strength is lacking, the heater is easily damaged, and durability of the heater is disadvantageously decreased. However, if the amount of potassium contained is too large, so as to exceed 100 ppm, dope pores increase too much, and in the instance of processing fine wires, the workability readily deteriorates and the manufacturing yield of the W wire decreases.

The tungsten wire relating to the present invention is not manufactured solely by performing conventional swaging processing and wire drawing processing of the above-described material (sintered compact), whereof the base is tungsten, but is manufactured by an additional rolling process as a preliminary process to the swaging processing and wire drawing process. Particularly regarding the rolling process, the processing rate (working ratio, cross-section is reduction rate) by means of rolling after 1 round of heating treatment (1 heat) is performed is stipulated to be 40 to 75%. Now, a processing rate of 40 to 75% by means of swaging processing instead of rolling is also effective, but the apparatus becomes complicated (for example, a higher load of swaging such as 4 directional swaging must be performed) and so this cannot be the most preferable manufacturing method.

Also, regarding the rolling process, by providing the high processing rate of 40 to 75%, the recrystallization temperature of the tungsten wire increases, and it becomes possible to improve the elongation of a tungsten wire of a final wire diameter of 0.020 to 0.090 mm to be 2% or even 5% after heating by applying electricity with a current of which the ratio to fusion current is 37 to 87%. Therefore, due to the result of the peak temperature of elongation after the electricity application heating treatment being shifted towards a higher temperature side, a tungsten wire ideal for components of a cathode heater or vibration service lamp used at higher operating temperatures, or manufactured at a higher processing temperature, can be effectively obtained.

Regarding the rolling process, in the case where a processing rate is too small, such as under 40%, not only the improvement effect of the elongation is small, but also the manufacturing rate decreases because the number of necessary swaging process and wire-drawing process repetitions increases to obtain the fixed wire diameter. In contrast, if the processing rate is excessive such as over 75%, the hardening during processing becomes noticeable, and cracks or rupturing of the tungsten wire would occur easily. Therefore, the processing rate at the rolling process is specified to a range of 40 to 75%, but the range of 50 to 75% is more preferable.

The tungsten wire according to the present invention is manufactured through the manufacturing processes illustrated specifically in FIG. 1. That is, a tungsten sintered compact (W sintered body) 1 comprising a fixed composition is heated to 1200 to 1500° C. in a heating apparatus 9 for rolling, then afterwards a rolling processing is performed in a rolling unit 10. For the rolling unit 10, a 2-directional roll rolling unit or a 3-directional roll rolling unit or a die roll rolling unit can be used.

The above rolling process can proceed at a high speed, and multiple stands of rolling processing can be completed before the temperature of the sintered compact 1 drops. That is to say, by simply performing one round of the heating process for tungsten sintered compact 1, a high processing rate of 40 to 75% can be obtained. Therefore, as compared to the conventional manufacturing method of manufacturing tungsten wire of a fixed wire diameter by performing only swaging and wire drawing processes on tungsten sintered compact 1, it becomes possible to greatly increase the manufacturing efficiency of tungsten wire.

The tungsten wire raw material 1*a* completed the rolling process is heated to above secondary recrystallization temperature (1800 to 2000° C.) in heat processing furnace 4, so as to remove strain and is sent to the swaging apparatus 3 after undergoing the recrystallization process. Within the swaging process, W wire raw material 1*a* is subjected to the repeated process of swaging by means of dice from surrounding directions (dice are pushed using a hammer) and the process of heating by the heating apparatus 2 for swaging use, and thus becomes a fine wire under the predetermined processing rate. In this swaging apparatus 3, it is difficult to set the processing speed high, and the processing rate capable of processing in 1 round of heat treatment is approximately 10 to 30%.

The tungsten raw material 1*b* that has been hammered is subjected to repetition of the process of heating in the heating apparatus 5 for wire drawing and the process of wire drawing in the wire drawing unit (wire drawing dice), and finally tungsten wire 7 possessing the desired fine wire diameter can be effectively obtained. Tungsten wire with a wire diameter of 40 μm prepared in this manner is provided with ideal strength and durability as a component for cathode heaters or vibration service lamps, as the elongation after electricity application heating for 2 minutes with a current at a ratio of 64 to 76% to the fusion current is 5% or greater.

The object of the present invention is a tungsten wire in the ideal wire diameter range of approximately 20 to 90 μm as component material particularly suitable for vibration service lamp filament and cathode heaters. Vibration service lamps mean lamps used in an environment that accompanies transferring motion or vibration, such as automobiles or pachinko machines and so forth.

Further, conventionally, in general an annealing processing is performed several times, for example at a wire diameter of 400 μm or below (for example, the heat processing temperature in the heating apparatus for wire drawing 5 shown in FIG. 2 was 800 to 1000° C.). However, in the manufacturing method according to the present invention, particularly when the wire diameter of the tungsten wire formed by the swaging processing or wire drawing processing is 100 μm or smaller, and when a strain removal heat processing at a temperature of 1200 to 2300° C. is performed, so that the hardening of the tungsten wire can be prevented and a wire material of a small wire diameter can be obtained without causing a breakage damage to the dice for wire drawing. Further, the above heat processing enables shifting the recrystallization temperature of the tungsten wire to the side of higher temperatures, and is preferable because the elongation, flexibility, shock resistance, and heat shock resistance of the tungsten wire is improved. Now, the above strain removal heat processing may be performed at a temperature of 1200 to 2300° C. in the heating apparatus for wire drawing 5 shown in FIG. 1, or may be performed by additionally providing a strain removal heat processing apparatus.

The tungsten (3% Re—W alloy) wire obtained through the processing as described above can have a tungsten wire elongation of 2% after the electricity application heating processing, wherein the electricity application heating processing temperature to the tungsten wire having each wire diameter (x μm), i.e. the ratio y of the heating current to the fusion current (FC) is set at a value within the range of the shaded portion shown in FIG. 3.

Further, regarding the 3% Re—W alloy wire, tungsten wire elongation of 5% can be realized after the electricity application heating processing, wherein the electricity application heating processing temperature to the tungsten wire having each wire diameter (x μm), i.e. the ratio y of the heating current to the fusion current (FC) is fixed at a value within the range of the shaded portion shown in FIG. 4.

The tungsten (26% Re—W alloy) wire obtained through the processing as described above can have a tungsten wire elongation of 2% after the electricity application heating processing, wherein the electricity application heating processing temperature to the tungsten wire having each wire diameter (x μm), i.e. the ratio y of the heating current to the fusion current (FC) is set at a value within the range of the shaded portion shown in FIG. 5.

Further, regarding the 26% Re—W alloy wire, tungsten wire elongation of 5% can be realized after the electricity application heating processing, wherein the is electricity application heating processing temperature to the tungsten wire having each wire diameter (x μm), i.e. the ratio y of the heating current to the fusion current (FC) is fixed at a value within the range of the shaded portion shown in FIG. 6.

With tungsten wire relating to the present invention which possesses excellent elongation even in cases of electricity application heating processing being performed, wherein wire diameter and heating current is set to the values within the range of the shaded portions indicated by FIG. 3 through FIG. 6, the elongation thereof does not decline in comparison with those of the conventional articles even in cases of heating processing being added to the manufacturing process for the purpose of obtaining cathode heaters and so forth from the tungsten, or even in cases of use at higher temperatures, and as the wire material thereof, the durability (lifespan) can be improved when using for cathode wires or vibration service lamp filament.

Here, the fusion current (FC) of the tungsten wire used in the present invention is defined as below. That is, within a bell jar wherein hydrogen or ammonolysis gas is flowed at a flow rate of $1.7\times10^{-4}$ $m^3/s$, a tungsten wire possessing the subject wire diameter is fixed so that the terminal-to-terminal length is 100 mm, electricity application heating is performed while the current value flowing between the terminals rises at an ascension rate of approximately 1 A/s, and the current value when the tungsten wire fuses is taken as the fusion current. Further, FC % indicated in FIG. 7 and FIG. 8 represents the percentage of the actual electricity application current value to the fusion current (FC). Now, FIG. 7 and FIG. 8 illustrate the relationship between the FC % and elongation, and ratio y (%) of the electricity application heating current value to the fusion current (FC) corresponding to each respective elongation can be read from the FC % value which gives the sought elongation, wherein the side of the current is greater than the position indicating the peak elongation value. Now, as it can be clearly understood from the results shown in FIG. 7 and FIG. 8, the elongation peak of tungsten wire according to the present invention is at or above 2%, or even at or above 5%.

Further, the elongation of tungsten wire can be measured using the following measurement method. That is, a tungsten wire was subjected to electricity application heating for 2 minutes at a current value of a fixed ratio to the fusion current, and the tungsten wire of a wire diameter to be the object of a tension tester is fixed so that the object measurement length (gage length) is 50 mm, a tension test is performed under the conditions of tension speed 10 mm/min, the elongation is measured until the tungsten wire ruptures. Now, the reason for using 2 minutes for the electricity application heating time is that the electricity application time (holding time) is defined as 2 minutes in the recrystallization temperature measurement method (Table 2) of TMIAS0201: 1999 "Tungsten-Molybdenum wire and bar testing methods" (Tungsten-Molybdenum Industry Society Publishing). Further, for the tungsten wire of the present invention, the electricity application heating is not an essential component, but was included as an evaluation method.

According to the tungsten wire relating to the present invention, because tungsten fine wire is prepared after rolling which provides a high processing rate of 40 to 75% with one heating treatment for a tungsten sintered compact, recrystallization temperature can be raised effectively, and compared to conventional material, peak elongation after the electricity application heating treatment can be shifted towards a higher temperature side, and tungsten wire is obtained providing ideal strength and durability as a component material for cathode heater wires and vibration service lamp filaments which are used or processed at higher temperatures.

Further, due to being subjected to the rolling process wherein a high processing rate is obtained, the processing rate for swaging/wire drawing processes after the rolling can be made relatively small, and because the number of repetition of swaging/wire drawing processes can be reduced, the manufacturing process of tungsten wire can be simplified, and the manufacturing efficiency of tungsten wire is capable of being greatly improved.

Further, by using the tungsten wire of the present invention as a cathode heater or a vibration service lamp filament, a cathode heater or vibration service lamp filament having a high reliability can be obtained even in cases of use or processing at a higher temperature. Now, it goes without saying that the tungsten wire of the present invention may be also used in a probe pin or a general vacuum bulb filament as well.

EXPLANATION OF REFERENCE NUMERALS

Figure 1:
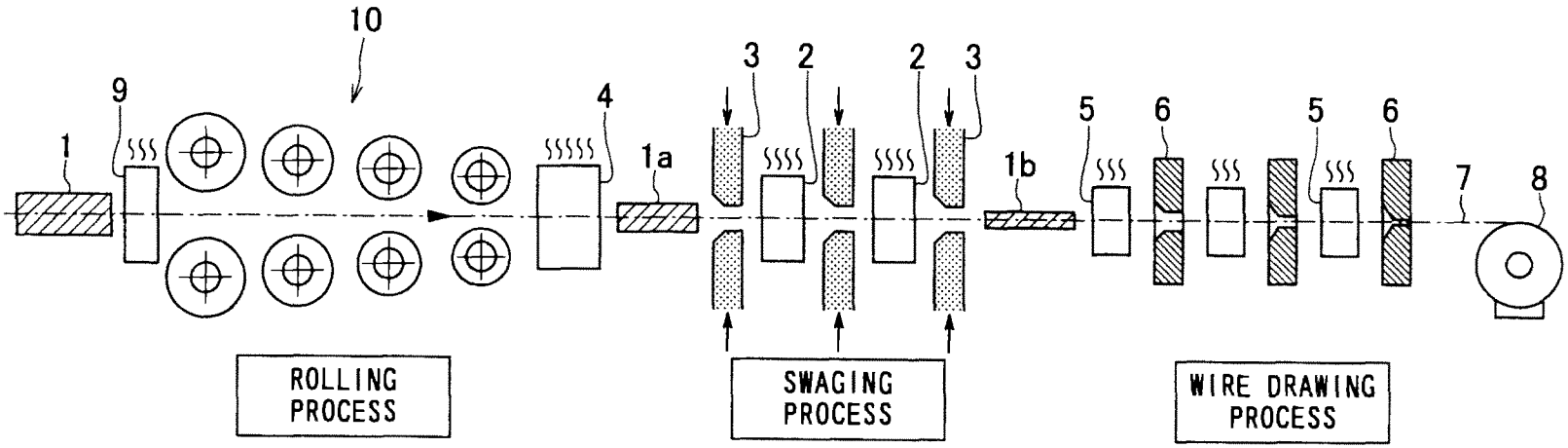
FIG. 1 is a schematic diagram illustrating the manufacturing process of a tungsten wire relating to the present invention.

1 tungsten sintered compact (W sintered body)
1*a*, 1*b* tungsten wire raw material
2 heating apparatus for use in swaging
3 swaging apparatus
4 heat processing furnace
5 heating apparatus for use in wire drawing
6 wire drawing unit (wire drawing dice)
7 tungsten wire
8 winding apparatus
9 heating apparatus for use in rolling
10 rolling unit
20 cathode heater
21 heating element, filament (tungsten wire)
22 ceramics film (ceramics coating)

BEST MODE FOR CARRYING OUT THE INVENTION

Next, detailed description of Examples of the present invention will be made by way of the following Examples and Comparative Examples, with reference to the accompanying drawings.

Examples 1 and 2

50 ppm of potassium (K) was doped into tungsten (W) powder of 3 μm average grain diameter, and after adding rhenium (Re) powder of 2 μm average grain diameter at a ratio of 3±0.3% by mass, the blended materials were uniformly mixed for 2 to 20 hours so as to prepare a raw material mixture. After the obtained raw material mixture was molded at a molding pressure of 200 MPa, and after pre-baking at 1100° C. in a hydrogen ambient atmosphere, electricity application sintering was performed, whereby 1.5 kg of W sintered body was prepared.

Next, the tungsten wire 7 according to the example wherein the final nominal wire diameter is set to 20-90 μm, was manufactured by following the manufacturing process illustrated in FIG. 1, and the W sintered body was processed in the order of rolling, recrystallization, swaging, and wire drawing. Now, the heating temperature in rolling heating apparatus 9 for the rolling process was set to 1300° C., while the processing rate was set at 50%. Further, the recrystallization temperature in the heat processing furnace 4 was set to 1900° C., while the heating temperature in the swaging heating apparatus 2 for the swaging processing was set to 1300° C., and the processing rate was set to 18%. Further, the heating temperature in the wire drawing heating apparatus 5 for the wire drawing process was set at 800° C., and the processing rate was set at 20%.

Now, within the above Examples, a tungsten wire which had been subjected to 1 second of strain removing heat processing (running annealing) at a temperature of 2300° C. at the point wherein the wire diameter became 100 μm during the swaging/wire drawing processes, was taken as Example 1.

Further, a tungsten wire which had been subjected to 1 second of strain removing heat processing (running annealing) at a temperature of 1200° C. at the point wherein the wire diameter became 100 μm, was taken called Example 2.

Comparative Example 1

Figure 2:
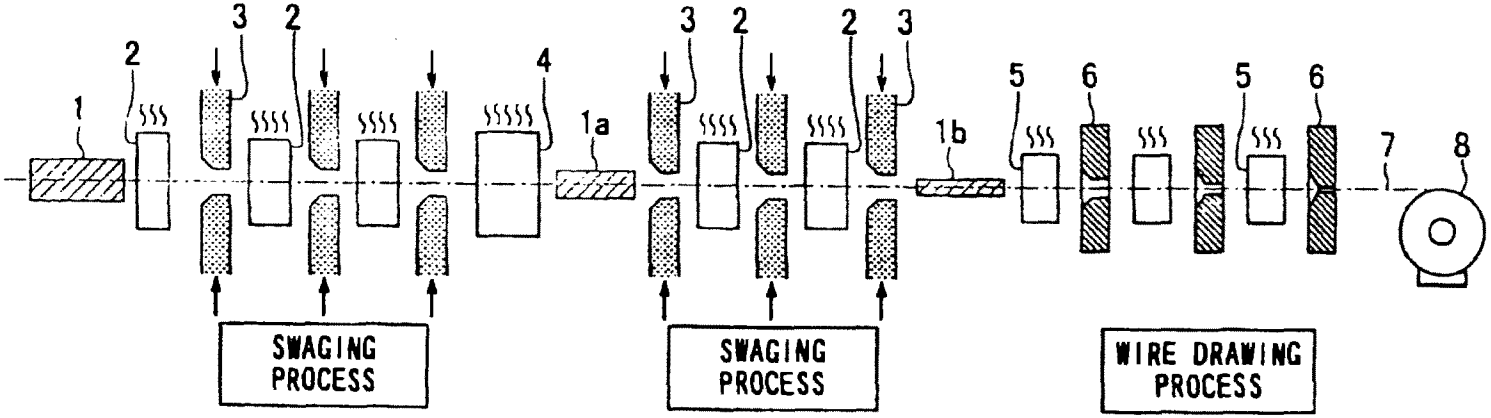
FIG. 2 is a schematic diagram illustrating the conventional manufacturing process of a tungsten wire.

On the other hand, as shown in FIG. 2, a manufacturing process solely comprising a swaging process and a wire drawing process was carried out without providing a rolling process by the rolling unit 10, and the heating temperature at the swaging process and the wire drawing process was fixed identically with Example 1, while the processing rate for each heating operation was fixed at 20% and the swaging/recrystallization/wire drawing processing were each repeated. Further, by performing 1 second of strain removing heat processing (running annealing) at a temperature of 2300° C. at the point wherein the wire diameter became 100 μm, whereby a tungsten wire with a nominal wire diameter of 20 to 90 μm according to the Comparative Example 1 was prepared.

Comparative Example 2

On the other hand, tungsten wire was prepared in the same manner as Example 1 except that the temperature for strain removing heat processing was set to 2500° C., which is outside the preferable range according to the present invention.

Figure 4:
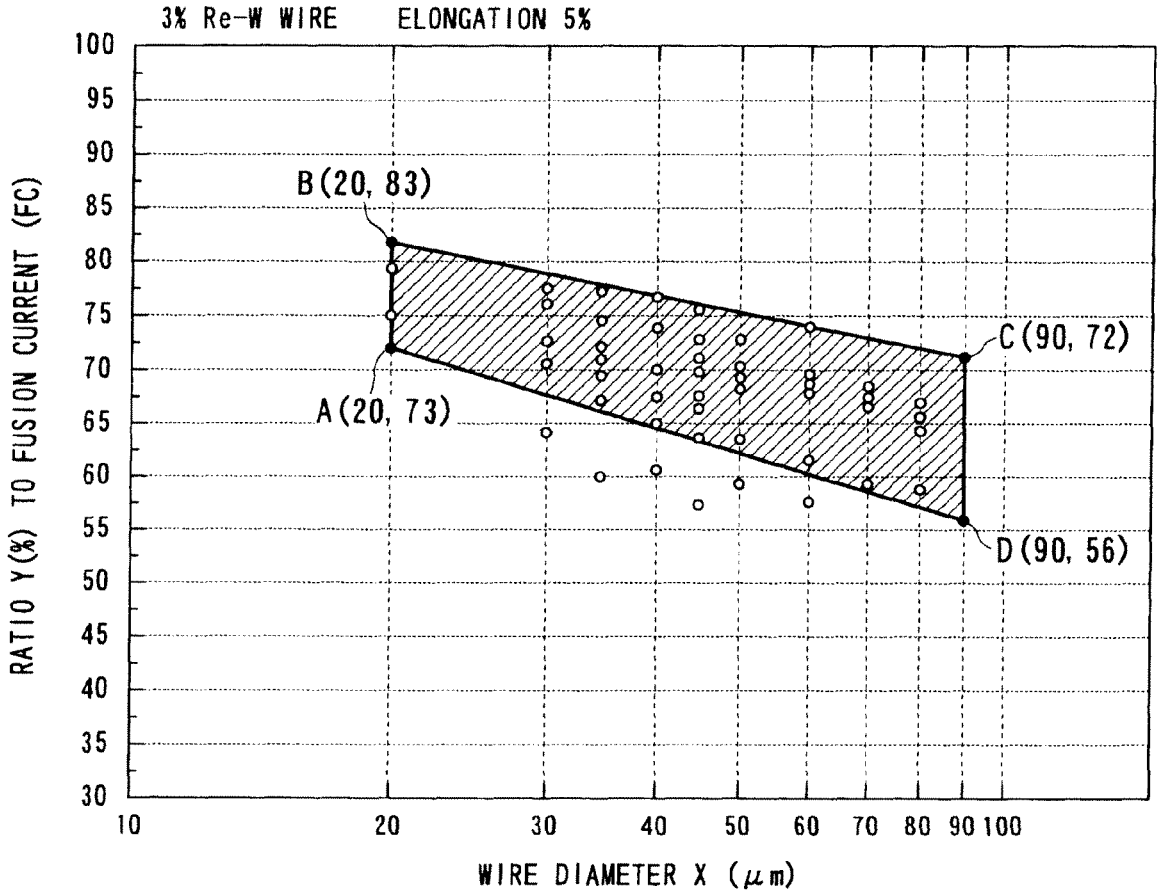
FIG. 4 is a graph illustrating the relationship between the ratio of heating current to fusion current and the wire diameter of a 3% Re—W wire relating to another Example of the present invention.

Regarding tungsten wires according to each of the Examples and the Comparative Examples prepared as above, in accordance with the aforementioned measuring method, after 2 minutes of electricity application heating was performed at a current of which the ratio was 10 to 95% of the fusion current (FC), thereafter the elongation was measured by further using a tension tester, As a result, there were points indicating a 5% elongation within the shaded range of FIG. 4, with the tungsten wires according to Examples 1 and 2.

Figure 3:
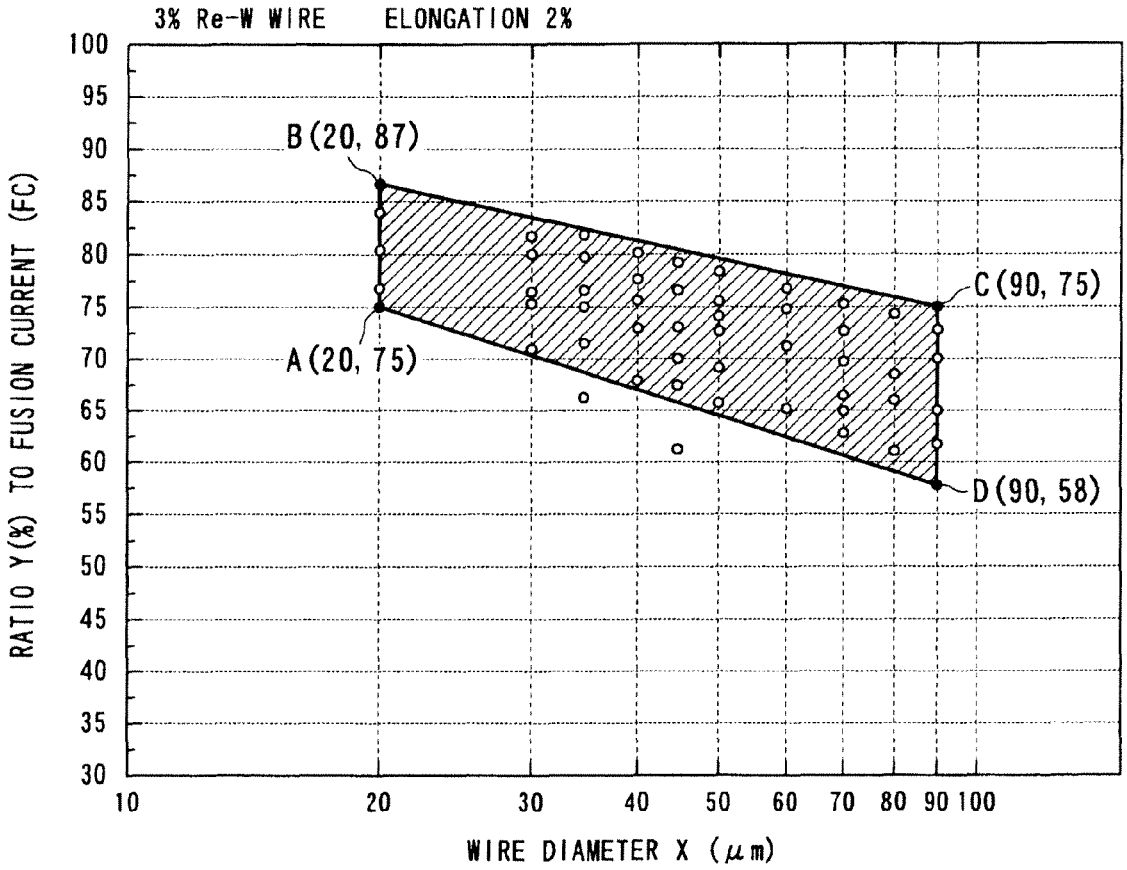
FIG. 3 is a graph illustrating the relationship between the ratio of heating current to fusion current and the wire diameter of a 3% Re—W wire relating to an Example of the present invention.

On the other hand, regarding the tungsten wires according to Comparative Examples 1 and 2, there were some points where the elongation peak reached 6% to 14% at a lower electricity application heating processing temperature, but when processed at a high electricity application heating process temperature indicated by the shaded portions of FIG. 3 and FIG. 4, it was confirmed that the elongation of each was less than 2% or less than 5%.

Figure 7:
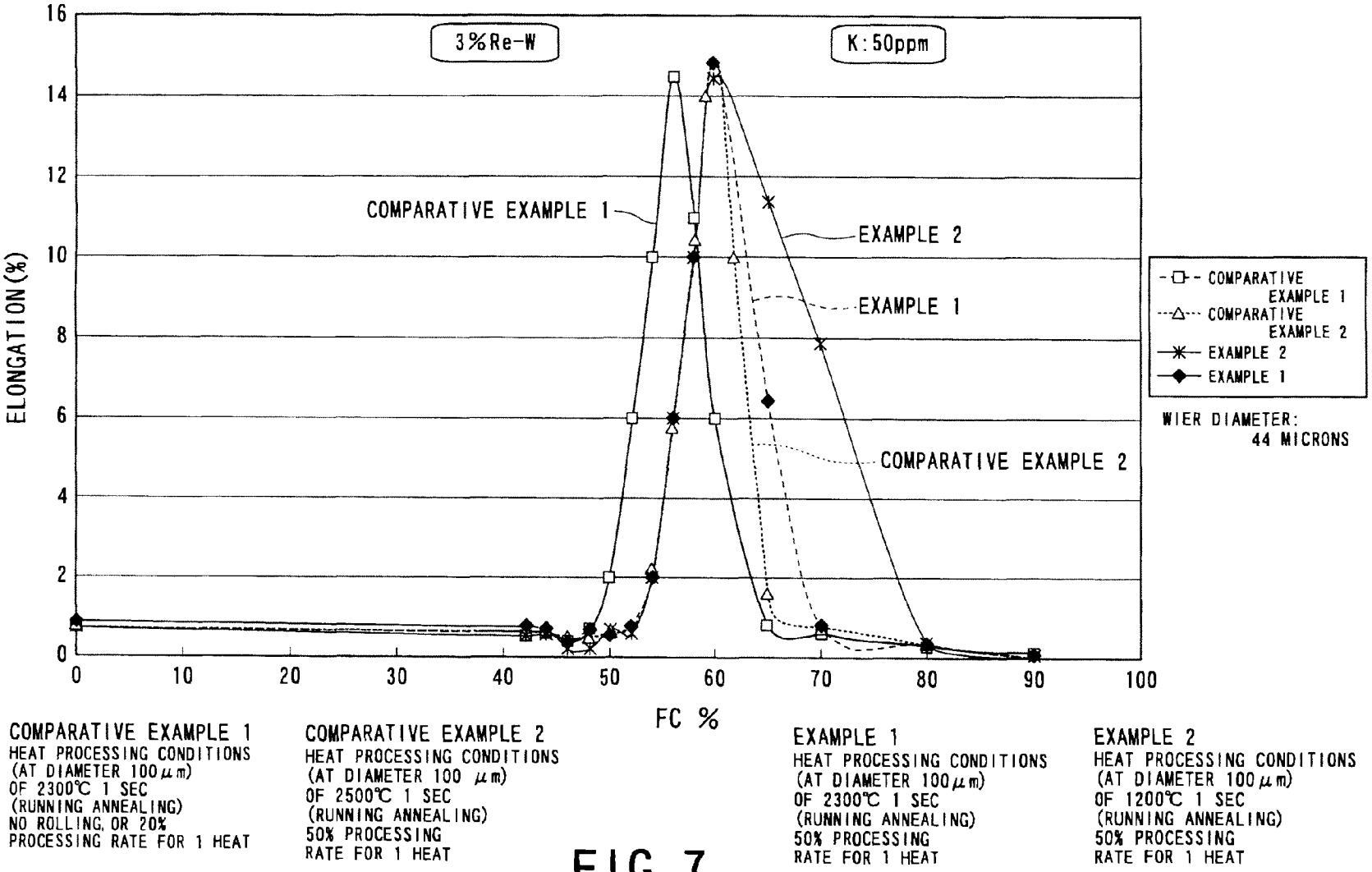
FIG. 7 is a graph illustrating the relationship between the elongation and the ratio (FC %) of the heating current to the fusion current in a tungsten (3% Re—W) wire of 44 μm wire diameter relating to Examples 1 and 2 of the present invention and Comparative Examples 1 and 2.

FIG. 7 is a graph denoting the relationship between the elongation and the FC % of the heat processing time of the tungsten wire relating to each of the Example and Comparative Examples each having the wire diameter of 44 μm. According to the tungsten wires relating to each of the present Examples, as compared with the conventional Comparative Examples, it can be confirmed that the temperature range exhibiting high elongation particularly after heat processing can be expanded towards higher temperature side, thereby exhibiting excellent heat resistance structural properties.

Examples 3 and 4

Rhenium (Re) powder having an average grain diameter of 2 μm was added to the tungsten (W) powder having an average grain diameter of 3 μm at a ratio of 26±0.5% by mass without doping potassium. Then the blended materials were uniformly mixed for 2 to 20 hours so as to prepare raw material mixtures. Then, each of the raw material mixtures was subjected to molding treatment and the electricity application sintering treatment as the same manner as that in Example 1, whereby W sintered bodies each having a weight of 1.5 kg was prepared.

Next, each of the W sintered bodies was processed in the order of rolling, recrystallization, swaging, and wire drawing in accordance with the manufacturing process illustrated in FIG. 1, so that tungsten wires 7 relating to the example having the final nominal wire diameter of 20 to 90 μm were manufactured. Now, in the above manufacturing process, the heating temperature in rolling heating apparatus 9 of the rolling process was set to 1300° C., while the processing rate was set to 50%. Further, the recrystallization temperature in heat processing furnace 4 was set to 1900° C., while the heating temperature in swaging heating apparatus 2 of the swaging processing was set to 1300° C., and the processing rate was set to 18%. Further, the heating temperature in wire drawing heating apparatus 5 in the wire drawing process was set to 800° C., and the processing rate was set to 20%.

Now, among the above examples, a tungsten wire which had been subjected to 1 second of strain removing heat processing (running annealing) at a temperature of 2300° C. at the point wherein the wire diameter became 100 μm during the swaging/wire drawing processes was taken as Example 3.

Further, a tungsten wire which had been subjected to 1 second of strain removing heat processing (running annealing) at a temperature of 1200° C. at the point wherein the wire diameter became 100 μm was taken as Example 4.

Comparative Example 3

On the other hand, as shown in FIG. 2, a manufacturing process solely comprising a swaging process and a wire drawing process was carried out without providing a rolling process by the rolling unit 10, and the heating temperature of the swaging process and the wire drawing process was set to the same as in Example 1, while the processing rate for each heat treatment was fixed at 20% and the swaging/recrystallization/wire drawing processing were each repeated, and further, the strain removing heat processing (running annealing) for 1 second was performed at a temperature of 2300° C. at the point wherein the wire diameter became 100 μm, so that a tungsten wire with a nominal wire diameter of 20 to 90 u m according to the Comparative Example 3 was prepared.

Regarding tungsten wire relating to each example and comparison example prepared as above, in accordance with the aforementioned measuring method, after 2 minutes of electricity application heating was performed at a current of which the ratio was 10 to 95% of the fusion current (FC), the elongation of each of the W wires was measured using a tension tester.

Figure 5:
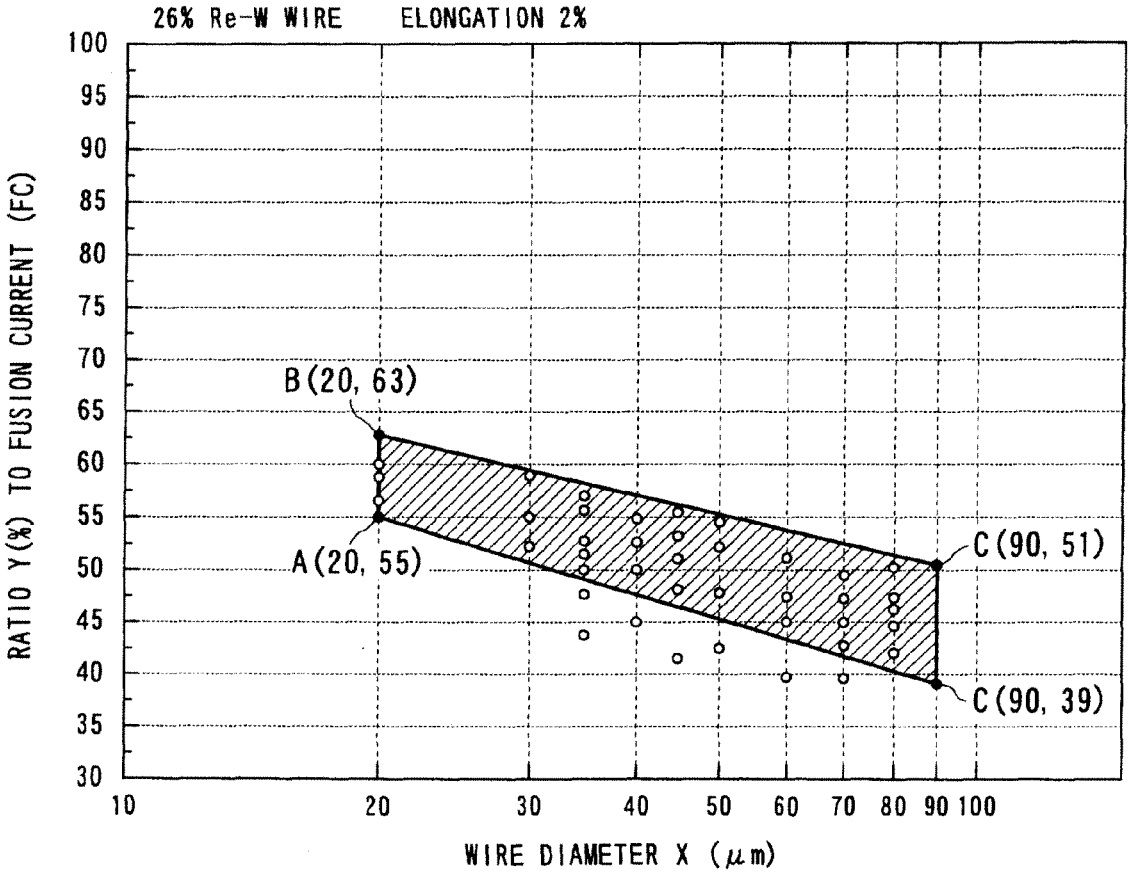
FIG. 5 is a graph illustrating the relationship between the ratio of heating current to fusion current and the wire diameter of a 26% Re—W wire relating to an Example of the present invention.

As a result, regarding the tungsten wires relating to Example 4, where annealing processing was performed at the stage when the wire diameter became 100 μm, some points exhibited an elongation of 2% or higher where electricity application heating was performed at the current value of ratio y to the fusion current in the range of the shaded portion in FIG. 5.

Figure 6:
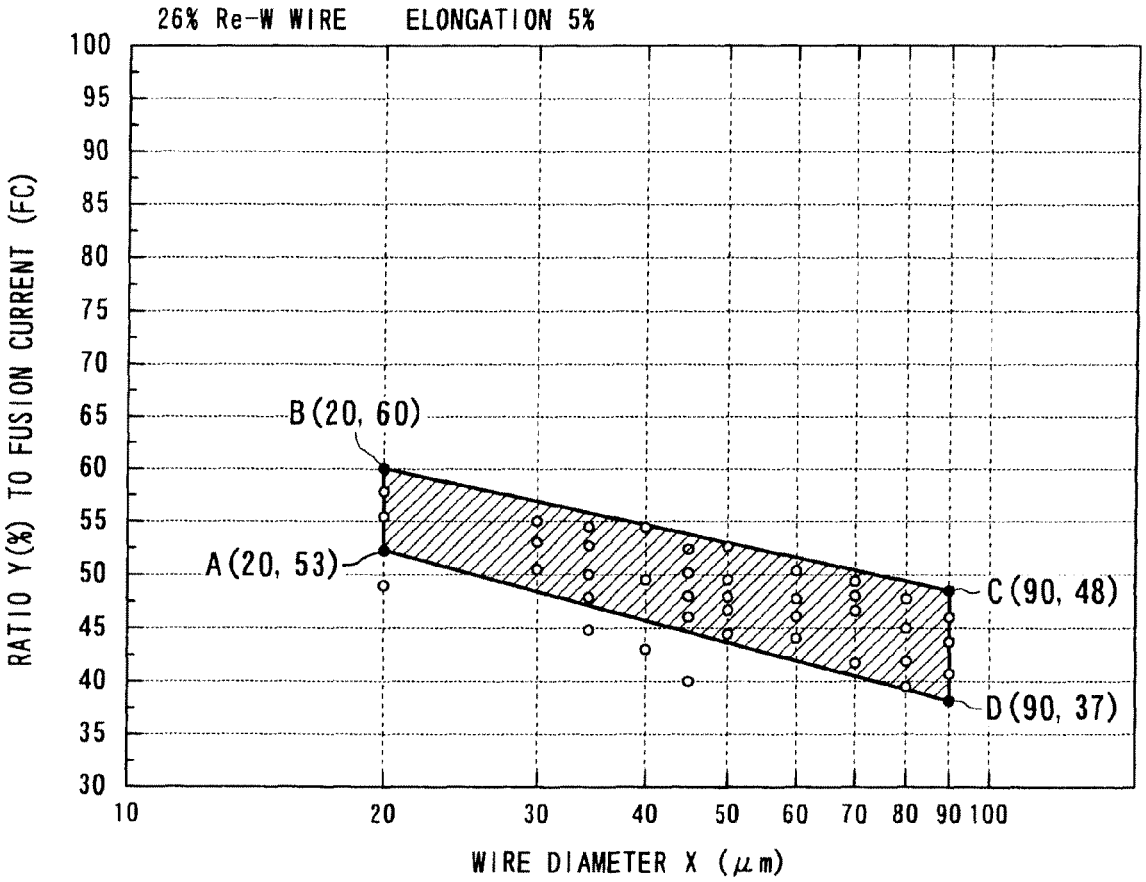
FIG. 6 is a graph illustrating the relationship between the ratio of heating current to fusion current and the wire diameter of a 26% Re—W wire relating to another Example of the present invention.

On the other hand, regarding the tungsten wire of Comparative Example 3, there were some points wherein the elongation peak reached 5% to 10% at a lower electricity application heating processing temperature, but when processed at a high electricity application heating process temperature indicated by the shaded portions of FIG. 5 and FIG. 6, it was confirmed that each elongation was less than 2% or less than 5%.

Figure 8:
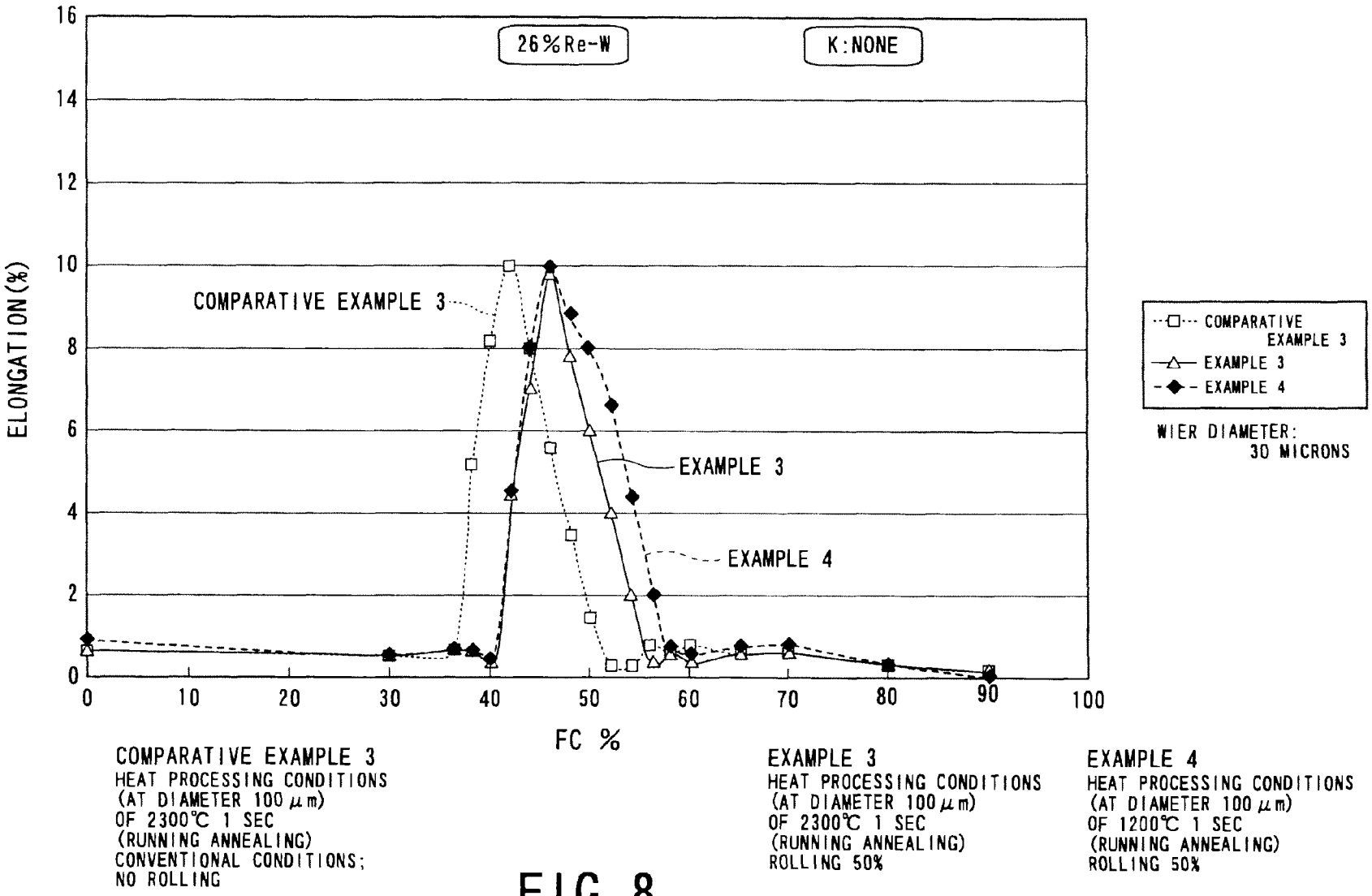
FIG. 8 is a graph illustrating the relationship between the elongation and the ratio (FC %) of the heating current to the fusion current in a tungsten (26% Re—W) wire of 30 μm wire diameter relating to Examples 3 and 4 of the present invention, and Comparative Example 3

FIG. 8 is a graph denoting the relationship between the elongation and the FC % of the heat processing time of the tungsten wire relating to each Examples and Comparative Example, wherein the wire diameter is 30 μm. According to the tungsten wire relating to the present Examples, compared with the conventional Comparative Example, it can be confirmed that the temperature range exhibiting high elongation particularly after heat processing can be expanded towards higher temperature side, thereby exhibiting excellent heat resistance structural properties.

In this manner, comparing the tungsten wires relating to the Examples formed through rolling processing which gives a high processing rate of 50%, as well as swaging/wire drawing processing, with the tungsten wires in the Comparative Examples which were formed solely by swaging/wire drawing processing, it was confirmed that the temperature range exhibiting high elongation after heat processing had expanded towards higher temperature side, and that excellent properties had been obtained as wire materials for cathode heaters or vibration service lamp filaments to be used at higher temperature conditions.

Further, regarding tungsten wires according to the Examples, since a high processing rate can be obtained through the rolling process, the tungsten wire manufacturing process can be simplified and manufacturing efficiency can be greatly improved, and it becomes possible to significantly lower the number of repetitions of the swaging processing and wire drawing processing necessary to obtain the fixed fine wire diameter.

Further, using a tungsten wire relating to the Example 1 and Comparison Example 1, a vibration service lamp filament with wire diameter 3.7 MG (35 μm) was manufactured. With respect to each filament, an IEC810 "Wide Range Vibration Test" was conducted, wherein vibration was applied to the filament while the bulb is lit, and the survival rate of each tungsten wire (filament) was measured. The results show a high survival rate of 75% for that of Example 1, as compared to a survival rate of approximately 30% for Comparative Example 1.

Figure 9:
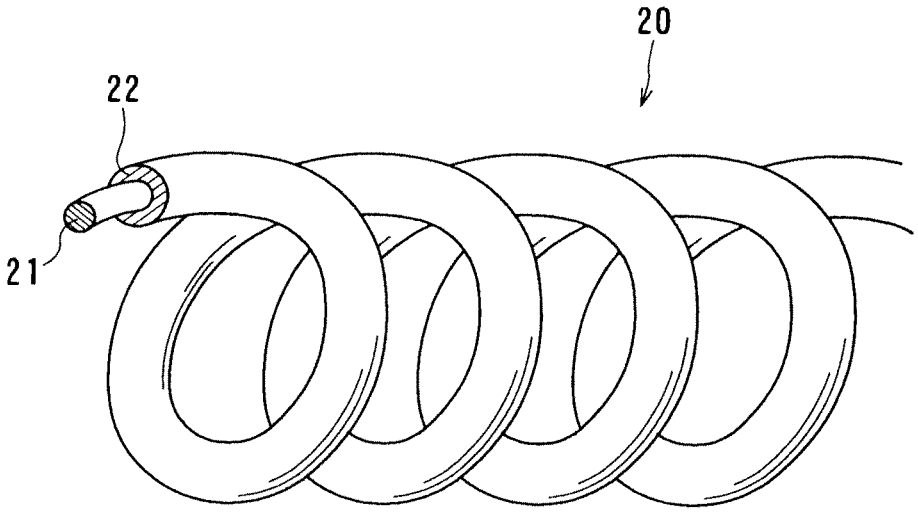
FIG. 9 is a perspective diagram illustrating a manufacturing example of a cathode heater formed by using a tungsten wire of the present invention.

Further, an alumina ($Al_2O_3$) coating with a thickness of 0.2 mm was provided onto the tungsten wire according to Example 1 and Comparative Example 1, whereby a cathode heater 20 such as indicated in FIG. 9 was manufactured. With respect to each of these cathode heaters, a vibration test similar to that of the vibration service lamp filament was performed. The results show an extremely high survival rate of 90% for the cathode heater according to Example 1, and exhibited excellent durability, whereas the survival rate of the cathode heater formed with a tungsten wire according to Comparative Example 1 was only 60%.

INDUSTRIAL APPLICABILITY

As described above, according to the tungsten wire of the present invention, the elongation of the tungsten wire after a high temperature heating process can be further improved, and there can be obtained the tungsten wire and cathode heaters and vibration service lamp filament having ideal strength and durability suitable for a component material constituting the cathode heater wire and vibration service lamp filament or the like.

The invention claimed is:

1. A method of manufacturing a tungsten wire containing 1 to 10% by mass of rhenium and 40 to 100 ppm of potassium, and having a wire diameter of 20-90 μm, the method comprising the steps of:

heating and rolling a tungsten sintered body containing 1 to 10% by mass of rhenium, wherein said rolling process utilizes a process rate of 40 to 75% for a rolling process with one heating process;

performing a recrystallization heat treatment;

heating and swaging the rolled sintered body after the recrystallization heat treatment;

heating and wire drawing the swaged sintered body;

performing an annealing treatment of said tungsten wire at a temperature of 800 to 1000° C. in a wire drawing step; and performing a strain removal heat treatment of said tungsten wire at a temperature of 1200 to 2300° C. at a time when a diameter of the tungsten wire formed by the swaging process or the wire drawing process is 100 μm or less;

said tungsten wire having a point which indicates a 2% elongation within a quadrangle formed by joining points with straight lines, where values of x and y are point (20, 75), point (20, 87), point (90, 75), and point (90, 58), in this order, wherein the wire diameter of said tungsten wire is represented by x μm, and the elongation of the tungsten wire is 2% after electrically heating with an electric current which is a ratio of y % to a fusion current (FC) at said wire diameter x μm, and wherein a semi-logarithmic system of coordinates is expressed by a horizontal axis using a logarithmic scale of said wire diameter x and a vertical axis using a normal scale of ratio y to said fusion current.

2. The method as claimed in claim 1, wherein the tungsten wire is capable of use at a temperature above 1.000° C.

3. The method as claimed in claim 1, wherein the tungsten wire is capable of use at a temperature above 2500° C.

4. The method as claimed in claim 1, wherein the tungsten wire has a 14% elongation at an FC of about 60%.

5. The method as claimed in claim 1, wherein the strain removal heat treatment is performed as a running anneal where the tungsten wire is moved during the strain removal heat treatment.

6. A method of manufacturing a tungsten wire containing 1 to 10% by mass of rhenium and 40 to 100 ppm of potassium, and having a wire diameter of 20-90 μm, the method comprising the steps of:

heating and rolling a tungsten sintered body containing 1 to 10% by mass of rhenium, wherein said rolling process utilizes a process rate of 40 to 75% for a rolling process with one heating process;

performing a recrystallization heat treatment;

heating and swaging the rolled sintered body after the recrystallization heat treatment;

heating and wire drawing the swaged sintered body;

performing an annealing treatment of said tungsten wire at a temperature of 800 to 1000° C. in a wire drawing step; and performing a strain removal heat treatment of said tungsten wire at a temperature of 1200 to 2300° C. at a time when a diameter of the tungsten wire formed by the swaging process or the wire drawing process is 100 μm or less;

said tungsten wire having a point which indicates a 5%, elongation within a quadrangle formed by joining points with straight lines, where values of x and y are point (20, 73), point (20, 83), point (90, 72), and point (90, 56), in this order, wherein the wire diameter of said tungsten wire is represented by x μm, and the elongation of the tungsten wire is 5% after electrically heating with an electric current which is a ratio of y % to a fusion current (FC) at said wire diameter x μm, and wherein a semi-logarithmic system of coordinates is expressed by a horizontal axis using a logarithmic scale of said wire diameter x and a vertical axis using a normal scale of ratio y to said fusion current.

7. The method as claimed in claim 6, wherein the tungsten wire is capable of use at a temperature above 1000° C.

8. The method as claimed in claim 6, wherein the tungsten wire is capable of use at a temperature above 2500° C.

9. The method as claimed in claim 6, wherein the strain removal heat treatment is performed as a running anneal where the tungsten wire is moved during the strain removal heat treatment.

10. A method of manufacturing a tungsten wire containing more than 10% by mass but 30% by mass or less of rhenium and 40 to 100 ppm of potassium, and having a wire diameter of 20-90 μm, the method comprising the steps of:

heating and rolling a tungsten sintered body containing 10 to 30% by mass of rhenium, wherein said rolling process utilizes a process rate of 40 to 75% for a rolling process with one heating process;

performing a recrystallization heat treatment;

heating and swaging the rolled sintered body after the recrystallization heat treatment;

heating and wire drawing the swaged sintered body;

performing an annealing treatment of said tungsten wire at a temperature of 800 to 1000° C. in a wire drawing step; and performing a strain removal heat treatment of said tungsten wire at a temperature of 1200 to 2300° C. at a time when a diameter of the tungsten wire formed by the swaging process or the wire drawing process is 100 μm or less;

said tungsten wire having a point which indicates a 2% elongation within a quadrangle formed by joining points with straight lines, where values of x and y are point (20, 55), point (20, 63), point (90, 51), and point (90, 39), in this order, wherein the wire diameter of said tungsten wire is represented by x μm, and the elongation of the tungsten wire is 2% after electrically heating with an electric current which is a ratio of y % to a fusion current (FC) in said wire diameter x μm, and wherein a semi-logarithmic system of coordinates is expressed by a horizontal axis using a logarithmic scale of said wire diameter x and a vertical axis using a normal scale of ratio y to said fusion current.

11. The method as claimed in claim 10, wherein the tungsten wire is capable of use at a temperature above 1000° C.

12. The method as claimed in claim 10, wherein the tungsten wire is capable of use at a temperature above 2500° C.

13. The method as claimed in claim 10, wherein the strain removal heat treatment is performed as a running anneal where the tungsten wire is moved during the strain removal heat treatment.

14. A method of manufacturing a tungsten wire containing more than 10% by mass but 30% by mass or less of rhenium and 40 to 100 ppm of potassium, and having a wire diameter of 20-90 μm, the method comprising the steps of:

heating and rolling a tungsten sintered body containing 10 to 30% by mass of rhenium, wherein said rolling process utilizes a process rate of 40 to 75% for a rolling process with one heating process;

performing a recrystallization heat treatment;

heating and swaging the rolled sintered body after the recrystallization heat treatment;

heating and wire drawing the swaged sintered body;

performing an annealing treatment of said tungsten wire at a temperature of 800 to 1000° C. in a wire drawing step; and performing a strain removal heat treatment of said tungsten wire at a temperature of 1200 to 2300° C. at a time when a diameter of the tungsten wire formed by the swaging process or the wire drawing process is 100 μm or less;

said tungsten wire having a point which indicates a 5% elongation within a quadrangle formed by joining points with straight lines, where values of x and y are point (20, 53), point (20, 60), point (90, 48), and point (90, 37), in that order, wherein the wire diameter of said tungsten wire is represented by x μm, and the elongation of the tungsten wire is 5% after electrically heating with an electrical current which is a ratio of y % to a fusion current (FC) at said wire diameter x μm, and wherein a semi-logarithmic system of coordinates is expressed by a horizontal axis using a logarithmic scale of said wire diameter x and a vertical axis using a normal scale of ratio y to said fusion current.

15. The method as claimed in claim 14, wherein the tungsten wire is capable of use at a temperature above 1000° C.

16. The method as claimed in claim 14, wherein the tungsten wire is capable of use at a temperature above 2500° C.

* * * * *